United States Patent [19]

Fisher

[11] 4,096,922

[45] Jun. 27, 1978

[54] ROOF SUPPORT SYSTEM FOR A SUSPENDED STAGING

[75] Inventor: Harry S. Fisher, Renton, Wash.

[73] Assignee: Spider Staging, Inc., Renton, Wash.

[21] Appl. No.: 809,553

[22] Filed: Jun. 24, 1977

[51] Int. Cl.[2] ..... E04G 3/10; E04G 3/14

[52] U.S. Cl. ..... 182/36; 182/142

[58] Field of Search ..... 182/82, 142, 36, 37, 182/143, 144, 45; 52/29, 27, 143; 187/7, 8; 214/16.4 A

[56] References Cited

U.S. PATENT DOCUMENTS

| | | | |
|---|---|---|---|
| 1,919,016 | 7/1933 | Geer | 182/143 |
| 3,237,717 | 3/1966 | Jackson | 182/45 |
| 3,854,550 | 12/1974 | Shingler | 182/36 |
| 4,048,924 | 9/1977 | Wibben | 182/45 |

FOREIGN PATENT DOCUMENTS

| | | | |
|---|---|---|---|
| 1,512,560 | 1/1968 | France | 182/36 |

*Primary Examiner*—Reinaldo P. Machado

*Attorney, Agent, or Firm*—Graybeal, Barnard & Uhlir

[57] ABSTRACT

An outrigger beam projects outwardly beyond the edge of the roof, to serve as an overhead anchor for the suspension line of a suspended staging. A support leg depends from the beam and makes contact with the roof inwardly of the roof edge. At a location further inwardly from the roof edge, the outrigger beam is secured to an elevated support rail, but in a manner permitting both axial and sideways angular movement, as needed, for proper positioning of the outboard end of the outrigger beam relative to the side of the building. The support rail counterbalances the weight of the staging. The outrigger beam is connected to the support rail by a carriage which permits (1) the outrigger beam to be pivoted vertically about the support rail, for raising the support leg up off the roof, and (2) sideways movement of the tilted outrigger beam lengthwise of the rail. A counterweight is provided at the inboard end of the outrigger beam to counterbalance the combined weight of the staging and the outboard portion of the outrigger beam.

22 Claims, 8 Drawing Figures

Fig. 3
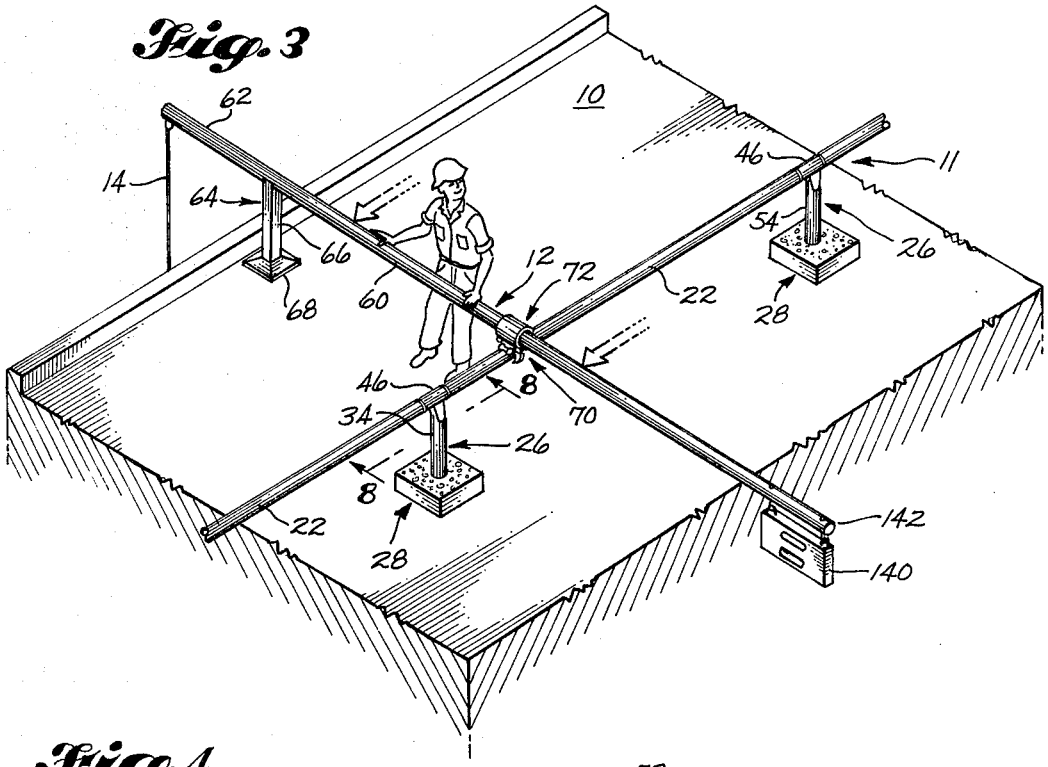
Fig. 4
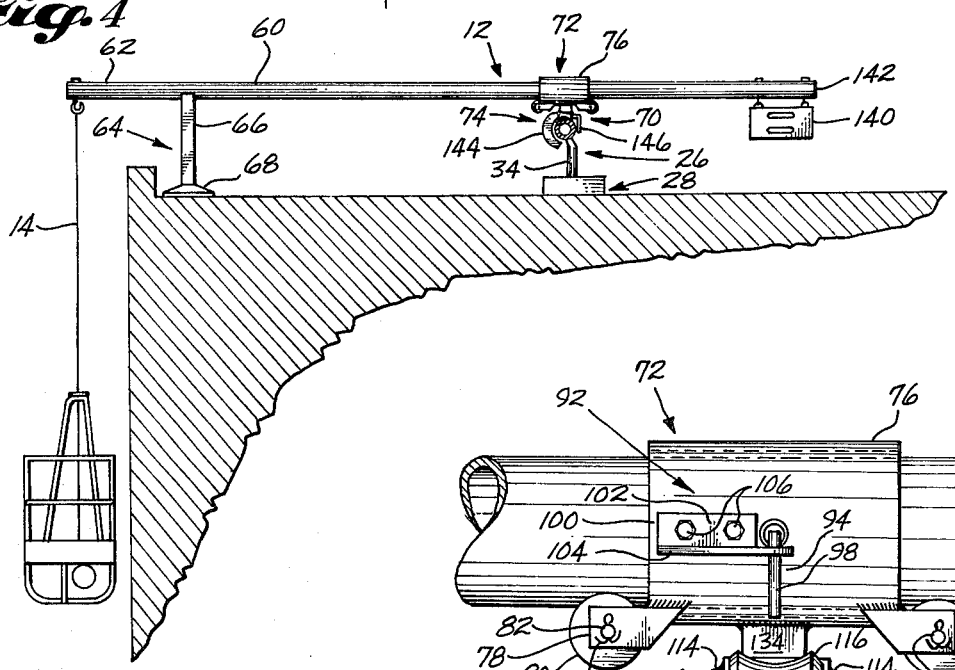
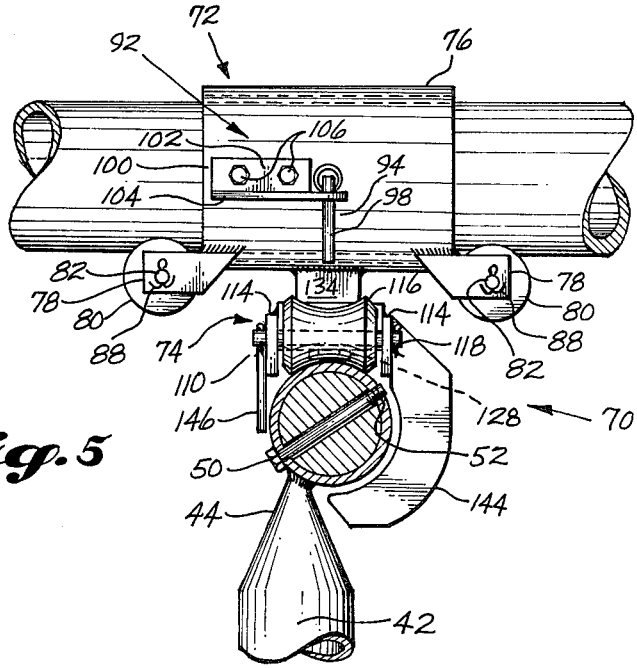
Fig. 5

ROOF SUPPORT SYSTEM FOR A SUSPENDED STAGING

BACKGROUND OF THE INVENTION

1. Field of the Invention

This invention relates to roof located support apparatus for suspended stagings, and in particular to such an apparatus which merely sits on and need not be built into the roof but yet provides a very safe and reliable anchor for the upper end of the suspension line for the suspended staging.

2. Description of the Prior Art

Examples of known suspended stageing apparatuses are disclosed by U.S. Pat. No. 2,998,094, granted Aug. 29, 1961 to Sidney L. Fisher, and by U.S. Pat. No. 3,994,036, granted Nov. 30, 1973, also to Sidney L. Fisher.

During its use a suspended staging is moved up and down along its suspension cable. Following each vertical pass, an apparatus on the roof of the building to which the upper end of the suspension cable is attached is stepped in position sideways so that the next vertical pass will be alongside the former vertical pass. It is believed that the most common support apparatus is in the nature of a wheeled vehicle which travels on a track or runway which is generally constructed on the roof as an integral part of the roof during construction of the building. One disadvantage of at least some roof support systems of this type is that they are quite expensive to install on the roof of a building after the building is completed. A second disadvantage of this type of system is that the vehicle must always be provided with a sufficient amount of counterweight in order to prevent it from toppling over under the weight of the suspended staging apparatus.

Spider Staging, Inc. of Renton, Washington, has for many years marketed a portable roof support system comprising an elongated outrigger beam for each staging unit. A major portion of such beam is in use disposed inwardly of the roof edge. A support leg depends from the beam and makes contact with the roof at a location inwardly a short distance from the roof edge. A minor portion of the beam projects outwardly from said leg, beyond the roof edge, and serves as an overhead anchor for the upper end of the suspension cable for the staging unit. An appropriate amount of counterweight is secured to the inboard end of the outrigger beam. An advantage of this type of roof support system is that it merely sets down on the building roof and does not include any components which have to be physically attached to or built into the roof. Thus, this type of roof support can be used on an old building which was never before equipped with a suspended staging apparatus. And, it can be easily moved onto the then off from the roof of a building to serve as a temporary support for a suspended staging apparatus which is brought to the building for temporary use only.

A disadvantage of the above described roof support system is that the outrigger beam is awkward and difficult to move in position about the perimeter of the building. Also, the safety of the system depends on the user always using an adequate amount of counterweight on each outrigger beam. The present invention relates to an improved version of this type of roof support system.

Examples of vehicular type roof supports for suspended stagings are disclosed by the following U.S. Pat.

Nos. 3,130,813, granted Apr. 28, 1964, to Karl Fackler and Alfred Weissflog; 3,456,756, granted July 22, 1969 to Billy J. Price and 3,854,550, granted Dec. 17, 1974, to Thomas M. Shingler. A boom type support is disclosed by U.S. Pat. No. 1,252,438, granted Jan. 8, 1918, to J. J. Hoffman. These patents and the prior art that was cited and considered by the Patent Office before granting them, and which is listed on the patents, should be consulted for the purpose of properly evaluating the subject invention and putting it into proper perspective.

BRIEF SUMMARY OF THE INVENTION

The instant invention relates to a novel semi-permanent support system for a suspending staging platform, composed of a mobile outrigger mounted to a guidance and support rail by carriage means, which rail serves to guide the outrigger along a predetermined path along the perimeter of a building roof, and further, which rail serves as a counterweight for counterbalancing the outrigger against the weight of the suspended scaffolding . The outrigger is formed by an elongated beam having an outboard end extending outward from the edge of the building roof to serve as an anchor for the suspension line of the suspended staging, which beam extends horizontally inward above the level of the roof to a point inboard of the rail. The outrigger beam is maintained in such horizontal orientation by a fulcrum or support leg depending from the beam, supporting in upward direction the beam near the roof's outer edge. In addition, the rail itself and acting through the carriage means exerts downward counterbalancing force on the inward end of the beam to restrain such inward end from upward movement. Support pedestals, which are anchored in weighted bases resting on the roof surface, both support individual rail sections in horizontal orientation above the roof level and interconnect adjacent rail sections to form a continuous rail system along the perimeter of the building roof. This construction allows the rail to be quickly and easily assembled either to form a permanent installation requiring no structural modifications to the pre-existing structure or to serve as a temporary installation which can be conveniently removed when the required work on the building is completed. Furthermore, by utilizing the rail itself to counterweight the outrigger against the weight of the suspended staging, no reliance is placed on the operator to insure that an adequate number of individual counterweights are placed on the staging support system. The carriage means includes guideway means which anti-frictionally guides the outrigger beam for convenient endwise adjustment relative to the rail to thus allow the suspended staging to be moved toward and away from the building face. The carriage means also includes mounting means having rollers to anti-frictionally mount the guideway means to the top surface of the rail. Furthermore, the guideway means is constructed to pivot in respect to the mounting means about a substantially vertical axis thereby enabling the outrigger beam to pivot in respect to the rail. The suspended staging, attached to the outboard end of the outrigger beam, can thereby be moved along the face or around the corner of a building simply by the pivotal movement of the outrigger beam about the mounting means and combined with the endwise adjustment of the outrigger beam in respect to the guideway means.

It is an object of the present invention, therefore, to provide a support system for a suspended staging platform comprising a mobile outrigger for rapid and easy movement of the staging along the building face, around the corner of a building, and toward and away from the building face.

Another object of the present invention is to provide a suspended staging support system that can be set on the roof of an existing building without requiring any structural modifications to the building.

A further object of the present invention is to provide a suspended staging support system to be used as part of a temporary installation, and thus is both portable, and easily assembled and disassembled without skilled labor, but which also could be left on a roof as part of a permanent installation.

Still another object is to provide a suspended staging in which the guidance and support rail itself serves to counterbalance the weight of the staging acting on the outrigger support system thereby eliminating the requirement that the operator remember to attach an adequate amount of counterweight to the support system to safely support the staging.

In addition, it is an object that the present invention be used in conjunction with a suspended staging requiring a single or a plurality of suspension lines.

Another object is to provide a support system for suspended stagings in which the spacing between outriggers can be rapidly adjusted to accommodate suspended stagings of different lengths.

One more object is to provide a suspended staging support system which is assembled from a minimum of standard components so that the same support system can be used on buildings of various shapes, thus minimizing the cost of the system.

Other and additional advantages will be apparent from the following description taken in conjunction with the accompanying drawings.

BRIEF DESCRIPTION OF THE DRAWINGS

FIG. 3 is a pictorial view illustrating how the mobile outrigger can be moved along the length of the support and guidance rail by a single operator;

FIG. 4 is a side elevation of the outrigger with a typical staging platform supported from its outboard end;

FIG. 5 is an enlarged fragmentary side elevation view of the outrigger shown in FIG. 4 illustrating the carriage means resting on a top surface of the rail;

DESCRIPTION OF THE PREFERRED EMBODIMENT

Figure 1:
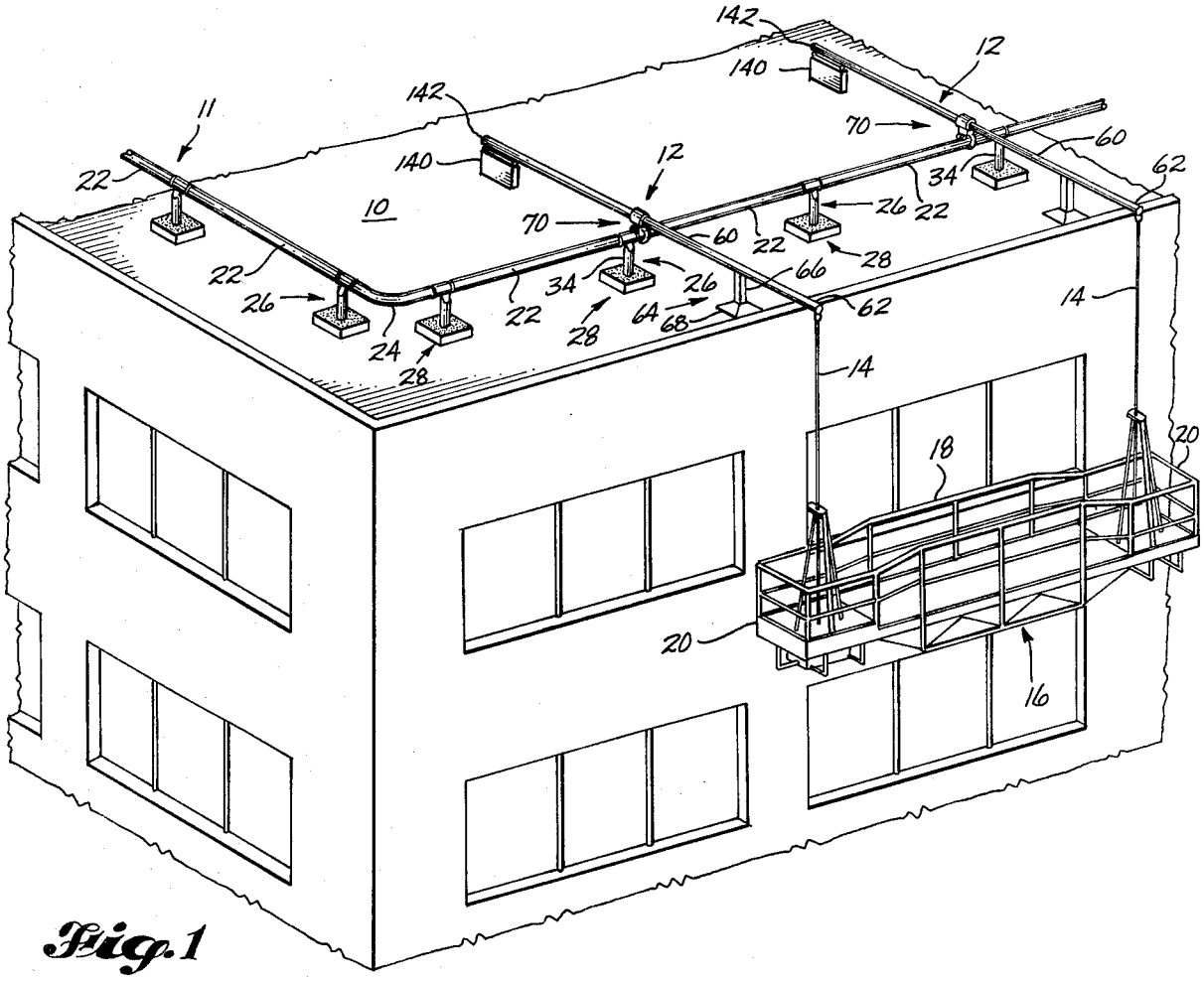
FIG. 1 is a pictorial view of an embodiment of the present invention shown sitting on a roof of a typical building, with a staging platform shown suspended from a pair of outriggers.

Referring initially to FIG. 1, shown setting on the roof 10 of a building is a typical staging support system constructed according to the instant invention. In preferred form, it comprises a support and guide rail 11 cooperating with a pair of outriggers 12 for suspending through suspension lines or cables 14, anchored to outriggers 12, a typical staging platform 16. Such staging platform can be of the type disclosed in the aforementioned U.S. Pat. No. 3,994,036, constructed of center bridge section 18 mounted to extend between a pair of vertically movable stagings 20. On the underside of each staging 20 is located a powered cable drum, not shown, for receiving suspension line 14 for movement of the staging platform 16 vertically along the face of a building. Rather than being used in conjunction with an elongated staging platform such as staging platform 16 and thus requiring a staging at each end, the instant invention by utilizing a single outrigger 12 can serve to support a staging platform composed of a single staging 20.

Figure 2:
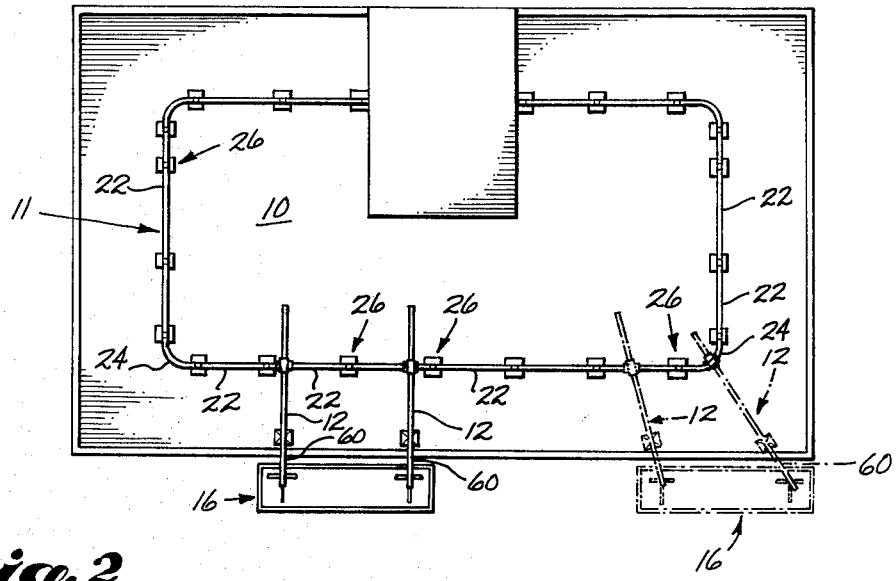
FIG. 2 is a plan view of the roof in FIG. 1 showing the rail extending along the perimeter of the roof and showing in solid lines a pair of outriggers supporting a suspended staging approximately centrally along the length of the building and showing in dot-dash lines a pair of outriggers supporting the suspended staging abutted with the corner of the building.
Figure 8:
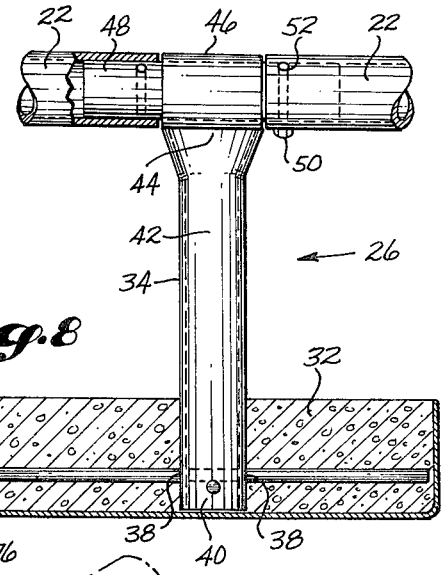
FIG. 8 is an elevation view of the support pedastal taken along the rail as shown in FIG. 3, illustrating the pedastal supporting adjacent rail sections in interconnected relationship.

Track 11, as shown in FIGS. 1 and 2, is constructed of a plurality of straight rail sections 22 and curved rail sections 24 interconnected by support pedastals 26 to form a continuous rail above the level of the roof along the perimeter of building roof 10. It will be understood that rail sections in varying shapes can be provided to be used in conjunction with buildings having a roof perimeter other than in the standard rectangular shape as shown in FIG. 2. Straight rail section 22 and curved rail section 24 are shown in FIGS. 5 and 8 to be constructed of tubular members having preferably a rounded cross-section. However, the rail sections can just as readily be formed from tubular members having other cross-sections such as square or rectangular.

As best shown in FIG. 8, the support pedastal 26, which serves both to interconnect and support horizontally adjacent rail sections, may include a weighted base 28 constructed preferably of a portable mold 30 filled with concrete 32. This type of construction allows a workman to conveniently mix the concrete and pour it into mold 30 while on building roof 10. Upstanding tubular post 34 is anchored in concrete base 28 with the aid of reinforcing bar 36 extending horizontally through diametrically opposed holes 38 provided in the lower end 40 of such upstanding post. The upper end 42 of post 34 is flattened to deform the cylindrical tubing, from which the upstanding post 34 is constructed, to form a straight elongated tip or apex 44, as shown in FIG. 5. A central segment 46, having a length substantially equal to the length of tip or apex 44, as shown in FIG. 8, is lengthwise fixedly attached to such tip or apex by means such as welding. Because central segment 46 actually forms a portion of rail 11, it is constructed of cylindrical tubing of the same diameter as straight sections 22 and curved sections 24. Central segment 46 is shown in FIG. 5 as attached to tip or apex 44 along a line slightly offset from the bottom of central segment 46. The significance of this particular construction will be discussed in a later portion of this description.

Extending horizontally, longitudinally lengthwise from each end of central segment 46 is cylindrical connector sleeve 48. The outer diameter of such connector sleeve is slightly less than the inner diameter of straight rail sections 22 and curved rail sections 24, thus enabling such connector sleeve to slidably extend fully into the ends of adjacent rail section such that the ends of such rail sections abut the end of the central segment 46 to form a continuous rail 11. A fastener in the form of capscrew 50, shown in FIG. 8, extends upward through clearance hole provided in the lower surface of rail section 22 and then through diametrically opposed clearance holes in connector sleeve 48 and into a tapped hole 52 provided in the upper surface of rail section 22. Such capscrew is of a length less than the outer diameter of rail section 22 to insure that when such rail section is connected to connector sleeve 48, such capscrew does not protrude above the upper surface of rail section 22. The significance of this particular construction will be explained fully in a later portion of the description.

Thus, from the foregoing description of the structure of rail 11 the ease and quickness of assemblying or disassemblying such rail on the roof of a building can be appreciated. The end of straight rail section 22 or curved rail section 24, as the case may be, is simply slid over support rail pedastal connector sleeve 48 and then capscrew 50 is simultaneously inserted through aligned holes provided in such rail section and such connector sleeve 48 to positively secure such members in interconnected relationship. It can also be appreciated that for most buildings, rail 11 can be simply constructed, from only straight rail sections 22 and curved rail sections 24 interconnected by support pedastals 26.

Outrigger 12, as best shown in FIGS. 3 and 4, is constructed of an elongated tubular outrigger beam 60 having an outboard end portion 62 projecting outward from the edge of building roof 10 to serve as an anchor for suspension line 14. Although outrigger beam 60 is shown constructed of cylindrical tubing, it should be appreciated that tubing of other cross-sections such as square or rectangular could also be readily used. Outrigger beam 60 is maintained in horizontal orientation against the weight of staging platform 16 by leg means 64 constructed from support leg 66 dependently secured to the outrigger beam at a location along the length of the beam adjacent to the outer edge of building roof 10. Attached to the lower end of support leg 66 is roof engaging pad 68 serving to distribute the weight of the staging platform 16 carried by leg means 64 over an area of building roof 10. Normally the weight of staging platform 16 acting on the outboard end 62 of outrigger beam 60 would tend to cause such beam to pivot about leg means 64. However, the entire weight of rail 11 acting through carriage means 70 as shown in FIGS. 3 and 4 counterbalances the weight of staging platform 16.

Figure 6:
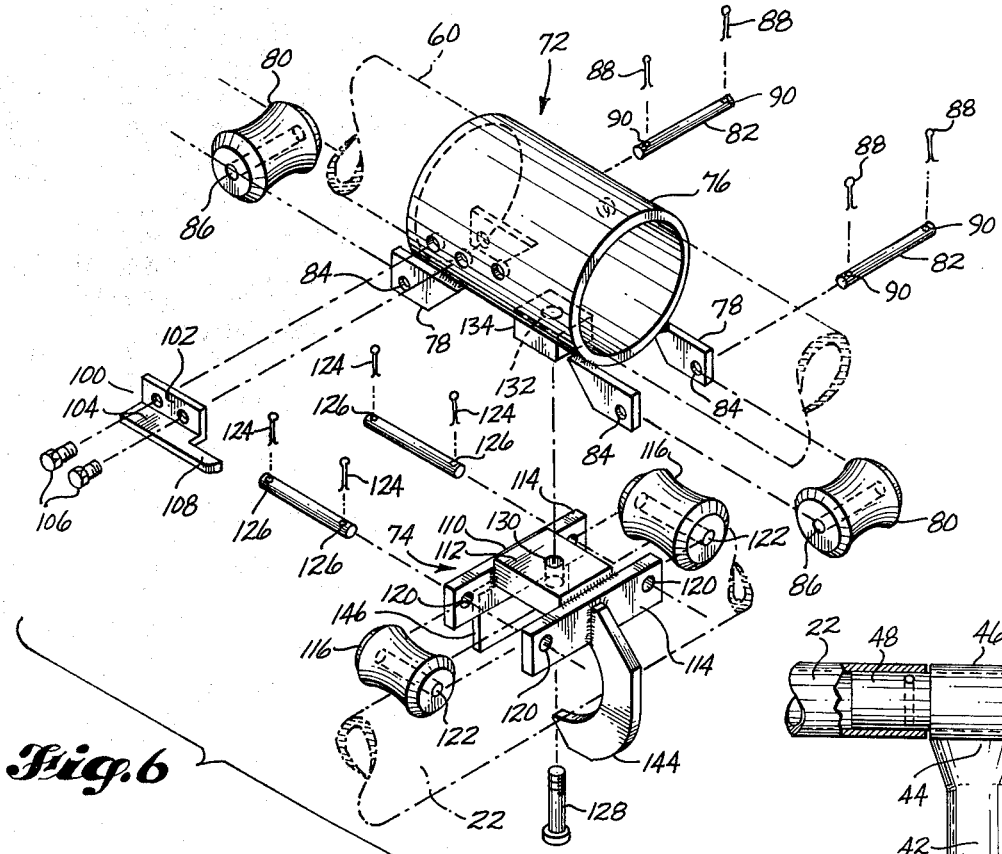
FIG. 6 is an exploded pictorial view of the carriage means, with portions of the outrigger beam and rail shown in dot-dash lines.
Figure 7:
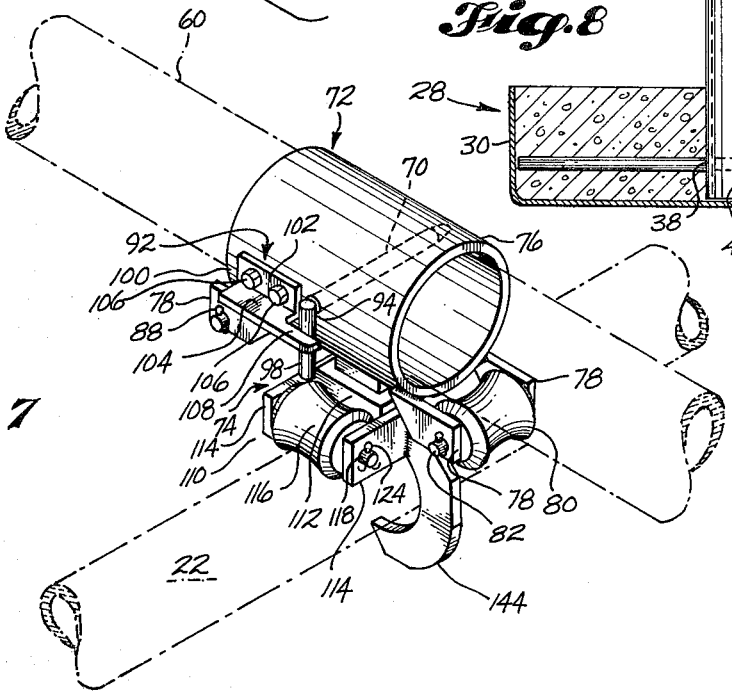
FIG. 7 is a pictorial view of the carriage means illustrating the outrigger beam, shown in dot-dash lines, assembled in the guideway means and illustrating the carriage mounting means installed on the rail, which rail is also shown in dot-dash lines.

Carriage means 70, as best shown in FIGS. 5–7, is constructed of two major components; guideway means 72 serving to guide outrigger beam 60 for endwise adjustment relative to rail 11, and mounting means 74 serving to mount such guideway means on the top surface of rail 11 for both translational movement of outrigger beam 60 along the length of rail 11 and for pivotal movement of such outrigger beam about the longitudinal axis of such rail.

Referring specifically to FIGS. 5 and 6, guideway means 72 is constructed of cylindrical collar 76 concentrically encircling outrigger beam 60 at a location along the length of such beam substantially inboard from leg means 64. Projecting lengthwise outward from the lower surface of each end of roller 76 are a pair of roller mounting ears 78 in spaced, parallel relationship having a distance between them adequate to receive outrigger beam roller 80. Such roller is axled to mounting ears 78 by roller pin 82 receivable simultaneously through aligned holes 84 located in the outboard end of such ears and through roller bore 86 located in the longitudinal centroid of roller 80. Roller pins 82 can be retained against axial movement by conventional fasteners such as cotter pins 88 receivable through holes 90 cross drilled into each end of such roller pin. Rollers 80 are made from nylon material and have a longitudinally concave surface of a curvature corresponding to the diameter of outrigger beam 60 to thus support such outrigger beam substantially concentric within collar 76 for anti-frictional endwise movement of such outrigger beam. Such endwise movement is required to adjust the distance between staging platform 16 and the face of a building and also to balance such outrigger beam for movement along the length of rail 11 as will be explained below.

Referring particularly to FIGS. 5–7, locking means 92 are provided to maintain in selective endwise position, outrigger beam 60 stationary in respect to guideway means 72. Such locking means include lock pin 94 having an elongated pin portion 96 simultaneously engageable through diametrically opposed holes provided in collar 76 and through diametrically opposed selective holes provided along the length of the outrigger beam 60. Fixedly attached at a right angle to the trailing end of elongated pin portion 96 is handle 98, which handle because of its weight normally tends to extend downward as shown in FIGS. 5 and 7. Keeper 100 is provided to maintain locked pin 94 engaged with both collar 76 and outrigger beam 60. Such keeper is preferably in the form of an angle shaped bracket formed by a vertical leg 102 and horizontal leg 104 extending outward from the lower edge of such vertical leg at an elevation slightly below the elevation of elongated pin portion 96. Keeper 100 is attached to collar 76 by capscrews 106 receivable through two spaced clearance holes located in vertical leg 120 and into corresponding tapped holes provided along the length of guideway collar 76 as shown in FIGS. 5–7. Extending horizontally lengthwise from the outer edge of horizontal leg 104 is finger 108 extending outward of and beyond handle 98 of lock pin 94 to restrain disengagement of such lock pin from guideway collar 76. Thus, prior to removing lock pin 94, handle 98 must be deliberately rotated from the vertical to approximately a horizontal orientation to clear finger 108.

Guideway means 72 as shown in FIGS. 5–7 is mounted on rail 11 by mounting means 74, which mounting means includes frame 110 constructed of rectangular pivot block 112 lying in horizontal orientation at an elevation above rail 12 and below guideway collar 76. Fixedly attached to the vertical lonitudinal edges of pivot block 112 are a pair of elongated roller mounting plates 114 in longitudinal, spaced, parallel relationship, with the ends of such roller mounting plates extending substantially beyond such pivot block. Axled to each end of frame 110 is mounting roller 116 made from nylon material and of a length to be receivable between spaced parallel roller mounting plates 114. As shown best in FIGS. 5 and 6, mounting rollers 116 are mounted to roller mounting plates 114 by mounting roller pin 118 simultaneously extending through aligned holes 120 provided in the outboard ends of roller mounting plates 114 and through bore 122 located at the longitudinal centroid of mounting rollers 116. Roller mounting pins 118 are retained against axial movement by a fastener attached to each end of such roller pin such as cotter pins 124 extending through cross-drilled holes 125 located in each end of such mounting roller pin.

Guideway means 72, as shown in FIG. 6, is pivotally mounted on carriage mounting means 74 by a connector means, preferably in the form of fastener 128, extending simultaneously upward through vertical clearance hole 130 centrally located in pivot block 112 and into tapped hole 132 centrally located in square boss 134 extending downward from the bottom surface of guideway collar 76. During the majority of the time that the staging support system of the present invention is in use, the length of outrigger beam 60, as shown in FIGS. 1 and 2, will be orientated substantially perpendicular to the length of rail 11. However, it is often necessary for workmen to gain access to the corner of a building such as for repair or cleaning purposes. Because rail 11 engages outrigger beam 60 inboard of leg means 64, rail 11, as shown in FIG. 2, cannot be positioned immediately adjacent to the edge of a building roof 10. Thus, to enable staging platform 16 to abut the corner of a building, outrigger beam 60, as shown by the dot-dash portion of FIG. 2, must be capable of pivoting in respect to the length of rail 11.

Referring again to mounting means rollers 116, shown in FIGS. 6 and 7, such rollers ride on the top surface of rail 11 to enable outrigger 12 through carriage means 70 to anti-frictionally translate along such rail length. To enable carriage means 70 to freely travel along rail 11, capscrew 50 connecting support pedastal 26 to straight segments 22 and curved rail segments 24, in the manner previously described, must not extend above the top surface of such rail. Furthermore, rollers 116 have a longitudinally convex surface curvature corresponding to the diameter of straight rail sections 22 and curved rail sections 24 for constraining carriage means 70 from lateral movement in respect to rail 11 during travel of such carriage means along such rail. Moreover, such roller curvature enables outrigger beam 60, acting through carriage means 70 to pivot about the length of rail 11 when a workman lifts up on outrigger beam 60 at a point outboard of rail 11 to raise foot 68 of leg means 64 off of the surface of roof 10 when desiring to move outrigger 12 along the length of rail 11. Once foot 68 is lifted off the roof, outrigger beam 60 can be lengthwise adjusted in respect to guideway means 74 until such beam is balanced about rail 11; the workman can then easily manually move outrigger 12 along the length of rail 11. To assist in the balancing of outrigger 12 about rail 11 for such translational movement, counterweight 140, as depicted in FIGS. 3 and 4, is suspended beneath outrigger beam 60 at inboard end 142 of such outrigger beam.

Referring now to FIG. 4, it will be appreciated that outrigger beam 60 will tend to pivot about fulcrum means 64 from the weight of staging platform 16 acting on outboard end 62 of such outrigger beam. As previously mentioned, rail 11 exerting downward force on outrigger beam 60 at a location inboard of leg means 64 serves to counterbalance against such pivotal movement of outrigger beam 60. To restrain carriage means 70 from being lifted off the top surface of rail 11 due to the tendency of outrigger beam 60 to pivot about leg means 64, such carriage means is provided with hook 144 fixedly attached to and extending downward from the exterior vertical surface of one of the two roller mounting plates 114 to partially encircle rail segment 22, FIG. 5. Fixedly attached to and extending downward from the exterior surface of the opposite roller mounting plate 114, is retaining plate 146. Such plate together with hook 144 cooperate to partially encircle rail section 22 while forming, as shown in FIG. 5, an open segment between themselves of a distance less than the diameter of such rail to prevent carriage means 70 from being disengaged from such rail but of a distance sufficient to provide clearance between these two members and tip 44 of upstanding post 34 during movement of carriage 60 along rail 11.

Typical set up and use of the suspended staging support system of the present invention initially required the assembly of rail 11 on building roof 11. Straight rail sections 22 and curved rail sections 24 are interconnected by support pedastals 26 to form a continuous rail 11 along as much of the roof perimeter as is possible.

Outrigger 10 is received through carriage means guideway means collar 76 and then carriage mounting means 74 is mounted to rail 11 prior to such rail being completely assembled. Thereafter, outrigger 12 is adjusted lengthwise in respect to rail 11 until leg means 64, depending downward from outrigger beam 60, is substantially adjacent to the outer edge of building roof 10 as shown in FIG. 3. To prevent endwise movement of outrigger 12 in respect to rail 11, lock pin 94, FIG. 7, is engaged simultaneously through holes provided in guideway means collar 76 and through selective holes provided in outrigger beam 60. Counterweight 140 is then attached to inboard end 142 of outrigger beam 60. If an elongated staging platform such as platform 16, shown in FIG. 1, is to be used in conjunction with the instant support system, a second outrigger 12 must similarly be attached to rail 11. The spacing between outrigger 12 can be adjusted to accommodate the length of the particular staging platform being used.

Finally, supervision line 14, reeled on powered drums provided beneath each staging 20, is anchored to the outboard end 62 of outrigger beam 60. By actuating such powered drum, staging platform 16 can now be lifted off the ground surface for vertical movement in respect to a building.

When it is desired to move staging platform 16 along the length of a building, such platform is first lowered to the ground and then translated along the length of the building to the desired new position by use of wheels provided under such staging platform. Lock pin 94 is removed from guideway collar 76 and then outrigger 12 is adjusted lengthwise to balance about rail 11. In this balanced condition, as shown in FIG. 3, a single workman can now easily move outrigger 12 along rail 11 to the new position of staging platform 16. In this new location, outrigger 12 is again adjusted lengthwise to provide proper positioning of staging platform 16 outward from the face of the building, and thereafter lock pin 94 is re-engaged. This procedure is repeated for the second outrigger 12.

Staging platform 16 can be easily positioned to abut the corner of the building, as shown in dot-dash lines of FIG. 2, by positioning one carriage means 70 at the corner of rail 11 and the other carriage means along straight rail segment 22. Outriggers 12 can then be lengthwise and angularly adjusted to accommodate staging platform 16 in this position.

The scaffolding support system as thus assembled can be either left on building roof 10 as part of a permanent installation or quickly disassembled and removed for use on a different building. To disassemble the instant invention, suspension line 14 is removed from outrigger beam outboard end 62 and counterweight 140 is preferably removed from outrigger beam inboard end 142. Next, rail 11 is disassembled by unscrewing capscrews 50, as best shown in FIG. 8, prior to slidably disengaging straight rail sections 22 and curved rail sections 24 from connector sleeves 48 of support rail pedastal 26. Because of its compact size and relatively light weight, carriage means 70 can remain engaged with outrigger beam 60 without causing any appreciable awkwardness or burden during disassembly and removal of the instant staging support system. Carriage means 70 can be easily disengaged from rail 11 by simply rolling it along rail 11 to a disconnected end of rail segment.

In an alternative embodiment of the instant invention, a powered cable drum, not shown, can be attached to the top surface of outrigger beam 60 inboard of leg means 64. Suspension line 14, rather than being anchored to outboard end 62 of outrigger beam 60, is anchored to such powered drum. Eye bolts or other well-known means can be provided to guide suspension line 14 from such powered drum to outrigger beam outboard end 62. During normal operation, the power drum located beneath each staging 20 would be used to move staging platform 16 vertically along the building. However, if such staging powered drums fail to operate, the second powered drum located on outrigger 12 can be used to either raise staging platform 16 to the building roof or lower it to the ground so that workmen can be safely removed from such staging platform.

What is claimed is:

1. For use with a guidance and support rail positioned on a building roof above the roof level, inwardly from the roof edge, an outrigger which is co-operable with such rail for supporting a suspended staging from the roof, said outrigger comprising:

an elongated outrigger beam which during use extends outwardly from the side of the building;

carriage means including guideway means supporting said outrigger beam for endwise adjustment relative to the rail, and mounting means engageable with the rail, for mounting said guideway means onto the rail for both translational movement along the rail length and angular movement about the longitudinal axis of the rail;

said outrigger beam having an outboard end portion which during use projects outwardly of both the rail and the edge of the building roof, to serve as an overhead anchor for a suspension line of a suspended staging, and an inboard end portion which during use is positioned on the opposite side of the rail; and leg means for supporting said outrigger beam, said leg means depending from said outrigger at a location inwardly of said beam outboard end portion and outwardly of the rail.

2. The outrigger in claim 1, further comprising counterweight means connectible to the inboard end portion of said outrigger beam, to counterbalance the outrigger beam when it is desired to translate it sideways along the rail.

3. The outrigger in claim 1, in which the outrigger beam includes a length of tubing extending from beyond the outer edge of a building roof to a location inboard of the rail.

4. The outrigger in claim 1, in which the leg means includes a roof engaging pad secured to its lower end.

5. The outrigger in claim 1, including an adjustable connector means between the guideway means and the mounting means, providing sideways angular adjustment of the guideway means and the outrigger beam carried thereby relative to the rail.

6. The outrigger in claim 5, in which the guideway means includes a collar encircling the outrigger beam, anti-friction means for anti-frictionally supporting the outrigger beam for endwise adjustment relative to the rail and locking means for restraining lengthwise movement of the outrigger beam relative to the rail.

7. The outrigger in claim 1, in which the guideway means includes a collar encircling the outrigger beam, and a pair of rollers for anti-frictionally supporting the outrigger beam during lengthwise adjustment of the outrigger relative to said collar.

8. The outrigger in claim 7, and locking means for maintaining in selective lengthwise positions, the outrigger beam stationary in respect to the guideway means.

9. The outrigger in claim 8, in which the locking means includes the lock pin simultaneously engageable through diametrically opposed holes provided in the collar and through selective holes provided along the length of the outrigger beam, and a keeper for maintaining said lock pin in locked position.

10. The outrigger in claim 1, in which the carriage mounting means includes a frame for mounting the guideway means, roller means axled to said frame for mounting the carriage mounting means to the rail for anti-frictional translation of the carriage mounting means along the length of the rail and for pivotal movement of the carriage mounting means about the longitudinal axis of the rail, and retaining means for retaining the carriage mounting means from displacement upwardly of the rail.

11. The outrigger in claim 10, in which the retaining means is fixedly attached to the carriage mounting means frame and partially encircles the rail to prevent the carriage mounting means from being disengaged upwardly from the rail while allowing for movement of the carriage means along the rail length.

12. The outrigger in claim 10, in which the carriage mounting means frame includes exterior side surfaces; and in which the retaining means includes a retainer plate fixedly attached to one such side surface and extending beneath the carriage mounting means frame, and a hook fixedly attached to the opposite such frame side surface, said hook extending downward and cooperating with the retainer plate for partially enclosing the rail to prevent detachment of the carriage means from the rail while still allowing the carriage means to travel along the rail length.

13. In a scaffolding support system including an outrigger extending over the outer edge of a building roof, a guidance and support rail means positioned on the roof of a building inwardly from the edge of the roof for cooperating with such outrigger for supporting a suspended staging from the roof, said rail means comprising:

a sectional rail on which the outrigger beam is mounted substantially transversely of the rail length for translational movement along said rail, said rail sections comprising hollow tube sections, and said rail guiding the outrigger beam for traveling along a predetermined path along the perimeter of a building roof; and support pedestals for supporting said rail in horizontal attitude above the roof level, said support pedestal including two connector sleeves each extending into the end of an adjacent support rail section, fastener means for attaching said connector sleeves to the rail sections, a central segment fixedly connecting together the two connector sleeves, said segment abutting the ends of said support rail sections and having an exterior shape and dimension substantially similar to the support rail sections to form when in interconnected relationship a continuous track surface, and an upstanding post supporting said central segment to allow movement of the carriage means over said central segment in lengthwise horizontal orientation above the level of a roof, and a roof contacting base attached to said leg lower end.

14. The scaffolding support system of claim 13, in which the rail includes both straight sections and curved sections, said sections interconnectible by the support pedastals located between adjacent rails to form a continuous rail extending along at least a portion of the perimeter of a building roof, inboard of the outer edge of such roof.

15. A scaffolding support system comprising:

a sectional support and guidance rail located on the roof of a building including:

a plurality of rail sections positioned above the roof level and substantially along at least a perimeter portion of the roof inwardly from the roof edge, and a plurality of support pedastals for supporting said rail sections in an elevated, continuous, interconnected horizontal relationship; and an outrigger cooperating with said rail for supporting a suspended scaffolding from the building roof including, an elongated outrigger beam having an outward end which during use extends outwardly from the edge of the building roof to serve as an anchor for the suspension line of a suspended staging, and an inboard portion which during use extends inboard of both the building edge and said rail, leg means for pivotally supporting the outrigger beam at a location inwardly of the building edge and outwardly of the rail, carriage means for supporting the outrigger beam for lenghthwise adjustment relative to said rail, for sideways movement of said beam along the length of said rail, and for pivotal movement both up and down about the axis of said rail and sideways, said carriage means also maintaining said outrigger beam engaged with said rail to restrain said loaded outrigger beam against rotational movement about said fulcrum, and counterweight means connectible to the inboard end portion of said outrigger beam for counterbalancing said outrigger beam during translation along said rail.

16. The scaffolding support system in claim 15, in which the horizontal rail sections include elongated cylindrical tube sections and curved cylindrical tube sections, said tube sections interconnected by the support pedastals to form a continuous rail along at least a portion of the perimeter of a building roof substantially parallel and inboard of such roof edge.

17. The scaffolding support system in claim 16, in which the support pedastal includes a concrete base, an upstanding post anchored in said concrete base, a cylindrical central segment of a diameter substantially similar to the rail sections, said central segment connected to in lengthwise horizontal orientation the upper end of said post, a sleeve projecting from each end of said central segment and slidably engageable to their full length into the ends of adjacent tube sections to interconnect adjacent tube sections, and fastening means for maintaining the tube sections engaged with said sleeve to form a continuous surface on which the carriage means rides.

18. The scaffolding system of claim 15, in which the outrigger beam leg means depends from the outrigger beam, and a roof engaging foot attached to the lower end of said leg.

19. The scaffold support system in claim 15, in which the carriage means includes:

guideway means having, a collar slidably encircling the outrigger beam, anti-friction means supporting the outrigger beam coaxially in said collar for anti-frictional telescoping adjustment of the outrigger in respect to said collar, and locking means for maintaining the outrigger beam in selective endwise positions in respect to the rail;

carriage mounting means having, a frame for mounting said guideway means, roller means axled to the frame for mounting said carriage mounting means to the rail for translational movement along the length of the rail and for pivotal movement about the longitudinal axis of the rail, and retaining means having two members depending downward from said carriage mounting means frame and partially encircling the rail forming an open segment between themselves of a width less than the width of the rail to prevent the carriage from becoming detached from the rail by the action of the loaded outrigger pivoting about the fulcrum; and pivot means for pivotally mounting the guideway means onto the carriage mounting means to allow the outrigger to pivot about an axis perpendicular to both the length of the outrigger beam and the length of the rail for enabling a suspended staging to abut the corner of a building.

20. The scaffold support system in claim 19, in which the outrigger beam includes a length of metal pipe, and in which the guideway anti-friction means includes a roller axled to each end of and perpendicular to the collar length, said roller surface having longitudinally concave curvature corresponding to the diameter of the outrigger beam for maintaining the outrigger beam centered coaxially in said collar.

21. The scaffold support system in claim 19, in which the rail elongated tube sections include pipe sections, and in which the roller means includes rollers made from nylon material, said rollers having a longitudinally concave surface curvature corresponding to the diameter of the rail tube sections to guide the carriage mounting means along the rail length while the outrigger beam is being translated along the rail and to enable the outrigger beam to pivot about the longitudinal axis of the rail.

22. In combination with a staging suspended therefrom, an outrigger mounting on a building roof having, an elongated outrigger beam with an outboard end portion projecting outward of the edge of a building roof to serve as an anchor for the suspension line of such suspended staging and at inboard end portion positioned inboard of the edge of a building roof, and leg means for supporting the outrigger beam at a location inward from the outer edge of a building roof;

a guidance and support rail located inboard of, and extending parallel to, the roof edge for supporting said outrigger beam above the roof level and for anchoring said outrigger beam against rotational movement about the base of the support leg;

carriage means mounting said outrigger beam to said rail including, guideway means receiving said outrigger beam for endwise adjustment relative to said rail, carriage mounting means engageable with said rail for mounting said guideway means to said rail for both translational movement along the rail length and rotational movement about the longitudinal axis of the rail, and retaining means depending from said carriage mounting menas for retaining said loaded outrigger beam against pivotal movement about the fulcrum;

counterweight means connectible to the inboard end portion of said outrigger beam for counterbalancing the outrigger beam during translational movement along the rail.

* * * * *